US008206124B1

(12) United States Patent
Varani et al.

(10) Patent No.: US 8,206,124 B1
(45) Date of Patent: Jun. 26, 2012

(54) OIL-GAS VAPOR COLLECTION, STORAGE, AND RECOVERY SYSTEM USING A VARIABLE VOLUME GAS BAG CONNECTED WITH A CONTROL SWITCH

(76) Inventors: Frederick T. Varani, Golden, CO (US); Paul B. Trost, Golden, CO (US)

( * ) Notice: Subject to any disclaimer, the term of this patent is extended or adjusted under 35 U.S.C. 154(b) by 881 days.

(21) Appl. No.: 12/142,902

(22) Filed: Jun. 20, 2008

Related U.S. Application Data

(60) Provisional application No. 60/936,180, filed on Jun. 20, 2007.

(51) Int. Cl.
*F04B 49/20* (2006.01)
*E21B 43/12* (2006.01)

(52) U.S. Cl. ..... 417/34; 137/565.17; 166/53

(58) Field of Classification Search ..... 417/34, 417/364; 175/207; 137/565.34, 565.17; 166/53, 267, 75.12; 138/30; 123/2, 3, 518, 123/519, 516, 447, 196 S, 196 R
See application file for complete search history.

(56) References Cited

U.S. PATENT DOCUMENTS

| | | | | | |
|---|---|---|---|---|---|
| 947,437 | A * | 1/1910 | Ellis | 417/10 |
| 1,327,999 | A * | 1/1920 | Hill | 417/33 |
| 1,705,792 | A * | 3/1929 | Vignere | 417/4 |
| 2,459,317 | A * | 1/1949 | Granberg | 138/30 |
| 2,634,681 | A * | 4/1953 | Rowell | 417/34 |
| 2,895,305 | A * | 7/1959 | Reed | 62/48.2 |
| 2,947,379 | A * | 8/1960 | Aubrey | 95/204 |
| 3,234,879 | A * | 2/1966 | Brown | 166/68.5 |
| 3,247,798 | A * | 4/1966 | Glasgow et al. | 166/68.5 |
| 3,450,162 | A * | 6/1969 | Mercier | 138/30 |
| 3,493,001 | A * | 2/1970 | Bevandich | 137/14 |
| 4,422,301 | A * | 12/1983 | Watt et al. | 62/48.2 |
| 4,579,565 | A * | 4/1986 | Heath | 95/15 |
| 5,135,360 | A * | 8/1992 | Anderson et al. | 417/53 |
| 5,139,390 | A * | 8/1992 | Rajewski | 417/53 |
| 5,367,882 | A * | 11/1994 | Lievens et al. | 62/48.2 |
| 5,651,389 | A * | 7/1997 | Anderson | 137/565.11 |
| 6,209,651 | B1 * | 4/2001 | Knight | 166/369 |
| 7,326,285 | B2 * | 2/2008 | Chowdhury | 96/243 |
| 7,350,581 | B2 * | 4/2008 | Wynn | 166/370 |
| 2010/0158717 | A1 * | 6/2010 | Vogt | 417/401 |

* cited by examiner

*Primary Examiner* — Devon C Kramer
*Assistant Examiner* — Nathan Zollinger

(57) ABSTRACT

An oil-gas vapor collection, storage, and recovery system ensures that no air or oxygen leakage into the production tank occurs when gauging and/or emptying a tank. The system provides a constant reservoir-type storage system by utilizing a variable volume gas bag, expanding with a surge of gas from the separator and with minimal water column pressure from the plunger lift system, thereby containing the gas surge, but contracting with gas dissipation thus minimizing the compressor cycling, while accommodating rapid liquid and vapor influxes into the tank thus maintaining constant tank pressure. With expansion, the bag actuates a switch which activates a compressor, which, in turn, compresses the contained gas into the pipeline. Upon bag collapse, a switch is activated to turn off the compressor. Thus, the system provides constant storage tank pressure because the gas bag accommodates and controls variable gas volume.

1 Claim, 2 Drawing Sheets

MAINTENANCE/ FREQUENCY
1. OIL CHANGE IN COMPRESSOR EVERY 2 MONTHS
2. OIL CHANGE IN ENGINE EVERY 2 MONTHS.

SAFETY
1. FIELD PROVEN @ EXISTING EXPLOSIVE GASES INSTALLATIONS. (ie: COORS)
2. BUILT TO OILFIELD SPECIFICATIONS.

MAINTENANCE/ FREQUENCY
1. OIL CHANGE IN COMPRESSOR EVERY 2 MONTHS
2. OIL CHANGE IN ENGINE EVERY 2 MONTHS.

SAFETY
1. FIELD PROVEN @ EXISTING EXPLOSIVE GASES INSTALLATIONS. (ie: COORS)
2. BUILT TO OILFIELD SPECIFICATIONS.

OIL-GAS VAPOR COLLECTION, STORAGE, AND RECOVERY SYSTEM USING A VARIABLE VOLUME GAS BAG CONNECTED WITH A CONTROL SWITCH

CROSS-REFERENCE TO RELATED APPLICATIONS

U.S. Provisional Application No. 60/926,180 filed on Jun. 20, 2007

FEDERALLY SPONSORED RESEARCH OR DEVELOPMENT

Not Applicable

INCORPORATION BY REFERENCE OF MATERIAL SUBMITTED ON A COMPACT DISK

Not Applicable

SPECIFICATION

Be it known that we, Frederick T. Varani and Paul B. Trost, both citizens of the United States of America, have invented new and useful improvements in an oil-gas tank vapor collection, storage, and recovery system using a variable volume gas bag connected with a control switch as described in this specification. We claim benefit of the U.S. Provisional Application No. 60/926,180 filed on Jun. 20, 2007.

FIELD OF THE INVENTION

The present invention relates to oil and gas vapor collection systems and, more specifically to an oil and gas vapor collection, storage and recovery system using a variable volume gas bag connected with a control switch.

BACKGROUND OF THE INVENTION

Production tanks typically are a source of hydrocarbon vapors emitting into the atmosphere. Various systems are available for collection oil and gas vapors. Recently, the Colorado Department of Health has adopted regulations limiting emissions from production tanks. Depending on temperature, color of production tank, orientation to the sun, and gravity of the contained liquids, coupled with the normal separator operations, the amount of vapors may vary from minimal to in excess of 4 mcfd. Typically these vapors have a very high BTU content. Capture and beneficial usage of these vapors, as opposed to flaring, is both economically and environmentally advantageous. The present system ensures that no air or oxygen leakage into the production tank occurs when gauging and/or emptying the tank, plus provides a constant reservoir-type storage system by utilizing a variable volume, at a constant pressure, to minimize the compressor cycling and simultaneously accommodating rapid influxes of liquids and/or vapors into the tank. Thus, when the separator dumps or the plunger lift system adds significant volumes of both volatile oil-condensate, as well as the associated highly volatile gases, the surge of gas is accommodated by the present system. The gas is temporarily stored in an expandable gas storage bag which accommodates hydrocarbons. The bag collapses, like an accordion, when very little gas is present, but expands rapidly, and under minimal pressure of water column pressure of approximately 1 to 2 inches, to contain the surge of gas. As the bag expands, the bag actuates a switch when turns a compressor on. The compressor, in turn, compresses the contained gas and into the pipeline. As the bag decompresses and shrinks, a switch is activated to turn off the compressor. Thus, the present system allows the oil storage tank to operate at a constant pressure, but the gas storage bag accommodates variable gas volume.

SUMMARY OF THE INVENTION

The benefits of the present system include the recompression of gas for pipeline injection or re-injection into the well bore; use of gas for the oil-water separator, or heater treater and/or as an energy source for Ajax-type engines, as opposed to purchase of propane; and on-site produced water evaporation, thereby cutting water disposal costs. In addition, the system can operate without electrical service to the tank battery, which is convenient and eliminates the labor and costs of installing an electrical source for the tank. Payback for the system is site-specific, however, for a condensate production tank, payback is projected at 2.5 years.

As such, the general purpose of the present oil-gas condensate tank vapor collection, storage, and recovery system which has all of the advantages of the prior art mentioned heretofore and many novel features that result in an oil-gas condensate tank vapor collection, storage, and recovery system which is not anticipated, rendered obvious, suggested, or even implied by the prior art, either alone or in combination thereof.

An object of the present system is to provide gas recompression for pipeline injection or re-injection into a wellbore.

Another object of the present system is to use gas recovered by the present system for a tank-associated oil-water separator, heater treater, and/or as an energy source for an Ajax-type engine.

Yet another object of the present system is to eliminate the need to purchase and install a source of propane.

Still another object of the present system is to provide on-site produced water evaporation, thereby cutting water disposal costs.

Even still another object of the present system is to operate without electrical service to the tank battery.

Still yet another object of the present system is be cost-effective.

Even yet another object of the present system is to reduce the escape of vapors and the associated BTU content into the environment.

Thus has been broadly outlined the more important features of the present system so that the detailed description thereof that follows may be better understood and in order that the present contribution to the art may be better appreciated.

These together with additional objects, features and advantages of the present oil-gas condensate tank vapor collection, storage, and recovery system will be readily apparent to those of ordinary skill in the art upon reading the following detailed description of presently preferred, but nonetheless illustrative, embodiments of the present oil-gas condensate tank vapor collection, storage, and recovery system when taken in conjunction with the accompanying drawings. In this respect, before explaining the current embodiments of the present system in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the concept of this disclosure may be readily utilized as a basis for the design of other structures, methods, and kits for carrying out the several purposes of the present oil-gas condensate tank vapor collection, storage, and recovery system. It is therefore important that the claims be regarded as including such equivalent constructions insofar as they do not depart from the spirit and scope of the present invention.

Objects of the present system, along with various novel features that characterize the invention are particularly pointed out in the claims forming a part of this disclosure. For better understanding of the present system, its operating advantages and specific objects attained by its uses, refer to the accompanying drawings and description.

DETAILED DESCRIPTION OF THE DRAWINGS

Figure 1:
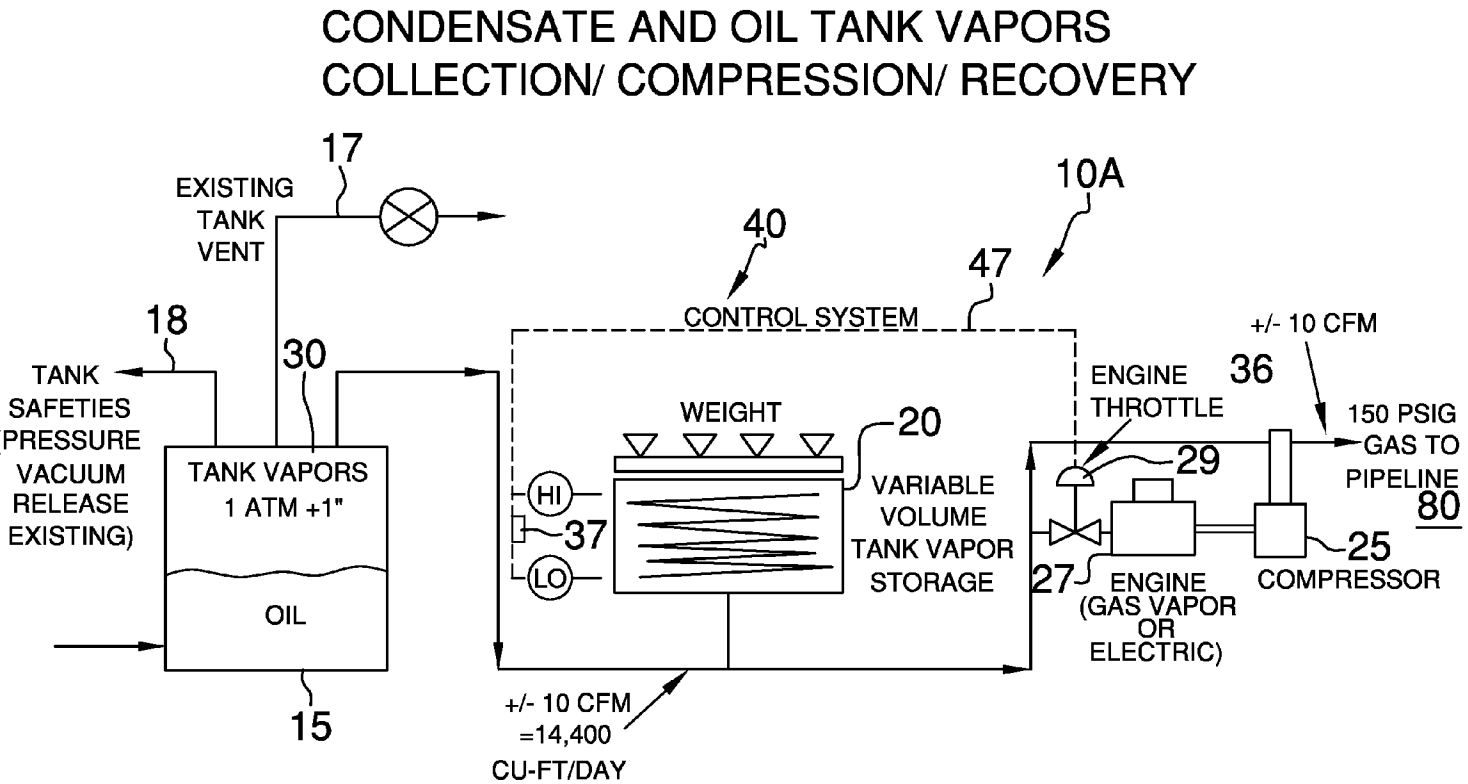
FIG. 1 is a schematic diagram of one embodiment.

FIG. 1 illustrates one embodiment of the present system 10A. The system 10A consists of an existing oil/liquid collection tank 15 usually associated with gas and oil wells, including wells typically found in the DJ Basin of Colorado. This system consists of an oil/liquid collection tank 15 having a vent 17 and a pressure vacuum release 18. The tank headspace 30 holds liquid offgas vapors, consisting of methane and higher hydrocarbon gasses, which are potentially useable as pipeline gas. The system 10A incorporates a variable volume storage assembly 20, which is a gas bag, to collect excess tank headspace 30 gas by expanding when gas or liquids are introduced into the tank 15. The gas bag 20 collapses when liquids are removed from the tank 15 or when the gas in the bag storage device 20 is recovered and ultimately sold to the pipeline 80. The system also provides a gas-powered compressor 25. Typically, a small gas engine 27 powered compressor 25 is inline with the gas bag 20. The engine 27 uses a small portion of the gas to operate a gas compressor 25, which pressurizes the tank headspace 30 gas to pipeline pressure for sale and reuse. Alternately, if electricity is available at the site, an electric-powered compressor may be utilized.

Another component of the present system 10A is the control system 40. A bag position indicator switch 37 operates the gas engine throttle 29. When the bag 20 is high, which indicates a large amount of gas is stored, the engine 27 operates at high speed and compresses the excess gas into the receiving pipeline 80. When the gas bag 20 goes low, which indicates that the headspace 30 gas is depleted, the engine 27 runs slowly and very little gas is compressed into the pipeline 80. This control system 40 consists of a plurality of mechanical linkages 47 between the bag 20 and engine throttle 29 and is either pressure-operated or electric-operated.

The wells usually do not have electricity available, so an additional benefit of the present system is the addition of a small generator, which is also powered by the headspace 30 gas engine to allow electric controls to be used at the wells.

Figure 2:
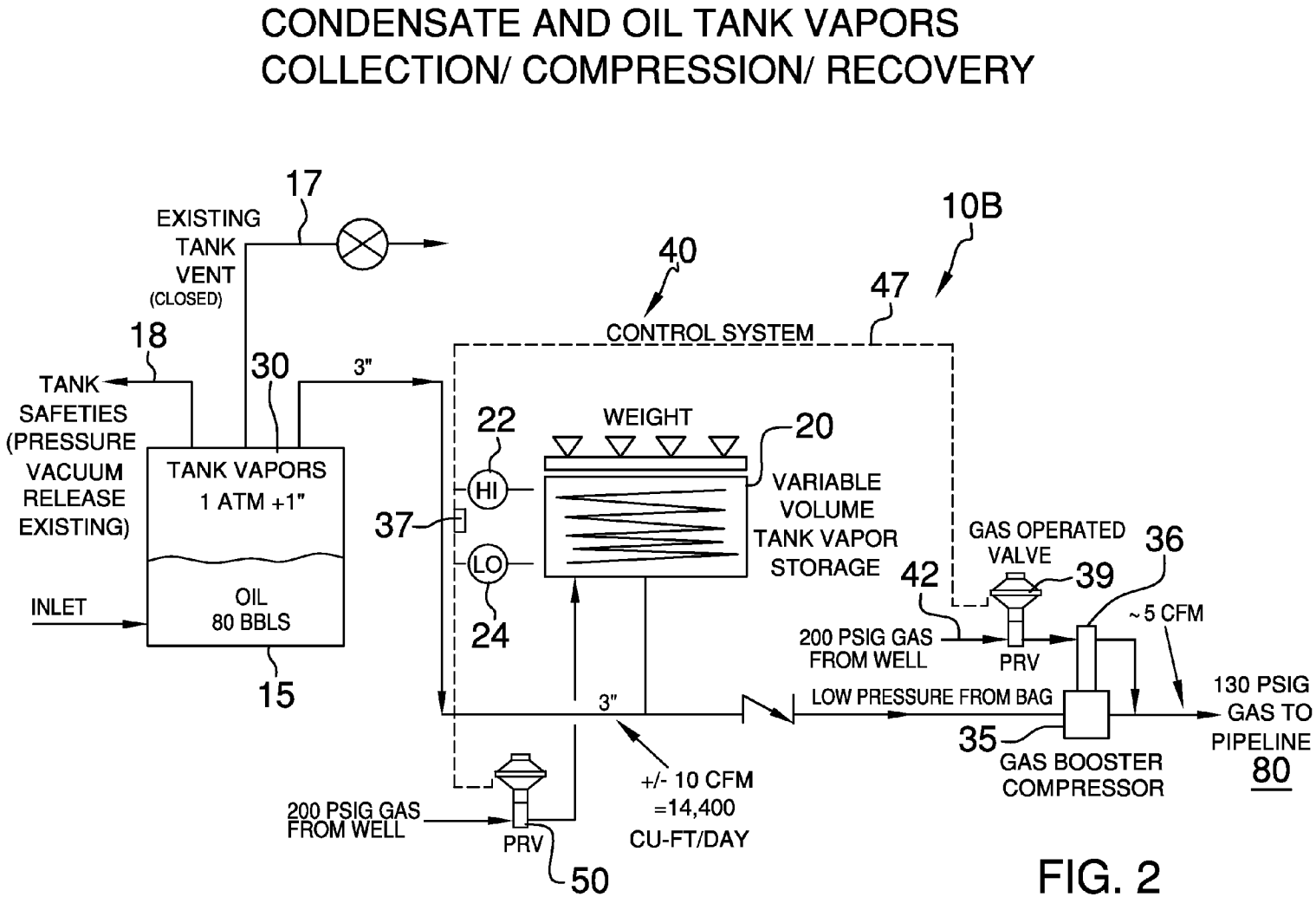
FIG. 2 is a schematic diagram of another embodiment.

An alternative to the foregoing system components, which is shown in FIG. 2, a gas booster compressor 35 is used to compress the gas at a well site without an electrical supply. The gas booster compressor 35 uses the wellhead gas pressure, at 200 psig, to power a small cylinder 36 which strokes a larger cylinder 35 connected directly to the power cylinder. The larger booster compressor 35 compresses the gas in the bag to the sale line pressure of 150 psig.

The control system 40 for the booster compressor 35 consists of a bag position switch 37 which directs the wellhead gas 42 to the gas booster compressor 35 thereby activating the compression process. When the bag 20 is high 22, which indicates a large amount of gas stored therein, the gas booster compressor 35 operates at high speed and compresses the excess gas into the receiving pipeline 80.

When the gas bag 20 goes low 24, which indicates that the headspace 30 gas is depleted, the bag position switch 37 directs gas into the bag 20 to prevent the bag 20 from going completely empty.

What is claimed is:

1. An oil-gas tank vapor collection, storage, and recovery system in combination with an oil and liquid collection tank associated with gas and oil wells, the tank having a vent, a pressure vacuum release, and containing fluids therein, wherein the tank is connected to an inlet pipeline, the system comprising:

a variable volume storage assembly wherein the assembly is a gas bag for the collection of headspace gas, the gas bag expanding when fluids are introduced into the collection tank, and the gas bag collapsing when fluids are removed from the collection tank and/or when the headspace gas in the gas bag is dispensed to a delivery pipeline; wherein the gas bag expands to a high position when the bag contains a high amount of headspace gas and collapses to a low position when the bag contains a low amount of headspace gas;

a small gas engine having a gas engine throttle, wherein the engine uses a portion of the headspace gas for operation;

a compressor driven by the gas engine to compress headspace gas into the delivery pipeline;

at least one mechanical linkage between the gas bag and the engine throttle, wherein the linkage is either pressure-operated or electric-operated; and a control system comprising:

a bag position indicator switch, wherein the indicator switch selectively moves the engine throttle into a high speed position when the bag is at the high position, whereby more headspace gas is compressed by the compressor into the delivery pipeline, and into a low speed position when the bag is at the low position, whereby less headspace gas is compressed by the compressor into the pipeline.

* * * * *